US009188922B2

(12) United States Patent
Murayama

(10) Patent No.: US 9,188,922 B2
(45) Date of Patent: Nov. 17, 2015

(54) IMAGE FORMING APPARATUS WITH SENSOR UNIT ASSEMBLY COVER MEMBER

(71) Applicant: Kentaro Murayama, Kasugai (JP)

(72) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/221,348

(22) Filed: Mar. 21, 2014

(65) Prior Publication Data

US 2014/0285611 A1 Sep. 25, 2014

(30) Foreign Application Priority Data

Mar. 22, 2013 (JP) ..... 2013-060093

(51) Int. Cl.
*B41J 15/14* (2006.01)
*B41J 27/00* (2006.01)
*G03G 15/00* (2006.01)

(52) U.S. Cl.
CPC ..... *G03G 15/50* (2013.01); *G03G 2215/00029* (2013.01)

(58) Field of Classification Search
CPC ..... G03G 2215/0424; B41J 13/32
USPC ..... 347/230, 238, 256, 257, 263, 240–242, 347/251; 399/144, 74, 49, 72; 358/401, 358/408, 462, 471, 472
See application file for complete search history.

(56) References Cited

U.S. PATENT DOCUMENTS

| | | | | |
|---|---|---|---|---|
| 6,659,578 | B2 * | 12/2003 | Gudaitis et al. | 347/3 |
| 6,690,457 | B2 * | 2/2004 | Yamaguchi | 356/139.1 |
| 7,068,962 | B2 * | 6/2006 | Suzuki et al. | 399/107 |
| 7,933,531 | B2 | 4/2011 | Hayakawa | |
| 2009/0169233 | A1 | 7/2009 | Hayakawa | |
| 2012/0076527 | A1 | 3/2012 | Goto | |

FOREIGN PATENT DOCUMENTS

| | | | | |
|---|---|---|---|---|
| JP | 2002-040743 A | | 2/2002 | |
| JP | 2002-131997 A | | 5/2002 | |
| JP | 2005024459 A | * | 1/2005 | G01N 21/47 |
| JP | 2009-157206 A | | 7/2009 | |
| JP | 2010-186143 A | | 8/2010 | |
| JP | 2012-073491 A | | 4/2012 | |

OTHER PUBLICATIONS

Co-pending U.S. Appl. No. 14/221,353, filed Mar. 21, 2014.

* cited by examiner

*Primary Examiner* — Hai C Pham
(74) *Attorney, Agent, or Firm* — Banner & Witcoff, Ltd.

(57) ABSTRACT

An image forming apparatus includes an image forming unit configured to form an image on a sheet, a sensor unit assembly including a sensor unit and a holder attached to the sensor unit, and a cover member attached to the sensor unit assembly. The sensor unit includes a light emitting element and a light receiving element. The cover member includes a light transmission portion covering a light emitting side of the light emitting element and a light receiving side of the light receiving element and an engaging portion sandwiched between the sensor unit and the holder.

13 Claims, 10 Drawing Sheets

WIDTH DIRECTION
ATTACHMENT DIRECTION
300
30
30G
30F
30C
30D
33
33A
33D
35(35B)
36A(35B)
36B(35B)
37(37B)
39
39A
39D
41
35(35A)
36A(35A)
36B(35A)
37(37A)
36A(35)
36B(35)
37
H1
H2

IMAGE FORMING APPARATUS WITH SENSOR UNIT ASSEMBLY COVER MEMBER

CROSS REFERENCE TO RELATED APPLICATION

This application claims priority from Japanese Patent Application No. 2013-060093, filed on Mar. 22, 2013, which is incorporated herein by reference in its entirety.

TECHNICAL FIELD

Aspects of the disclosure relate to an image forming apparatus configured to form an image on a sheet.

BACKGROUND

A known image forming apparatus includes a light emitting element, a light receiving element, and a transparent member covering a light emitting side of the light emitting element and a light receiving side of the light receiving element. The transparent member is detachably attached to a light path forming member.

A user or a maintenance operator can remove the transparent member from the light path forming member by moving the transparent member toward the front side in parallel to the light path forming member.

As the transparent member is configured to be removed from the light path forming member by parallel movement, the transparent member may come off unintentionally.

SUMMARY

Illustrative aspects of the disclosure provide an image forming apparatus that reduces a potential for a cover member, such as a transparent member, coming off unintentionally.

According to an aspect of the disclosure, an image forming apparatus includes an image forming unit configured to form an image on a sheet, a sensor unit assembly including a sensor unit and a holder attached to the sensor unit, and a cover member attached to the sensor unit assembly. The sensor unit includes a light emitting element and a light receiving element. The cover member includes a light transmission portion covering a light emitting side of the light emitting element and a light receiving side of the light receiving element and an engaging portion sandwiched between the sensor unit and the holder.

The engaging portion of the cover member is sandwiched between the holder and the sensor unit. This structure reduces a potential for the cover member coming off from the sensor unit assembly unintentionally.

BRIEF DESCRIPTION OF THE DRAWINGS

Illustrative aspects will be described in detail with reference to the following figures in which like elements are labeled with like numbers and in which.

DETAILED DESCRIPTION

The following description is directed to an illustrative embodiment of the disclosure. An electrophotographic image forming apparatus according to illustrative aspects of the disclosure will be described with reference to accompanying drawings.

Arrows indicating directions in each drawing are indicated to facilitate the understanding of positional relationships among components. For portions or components with numerals, at least one is provided unless "plural" or "two or more" is specifically stated otherwise.

Figure 1:
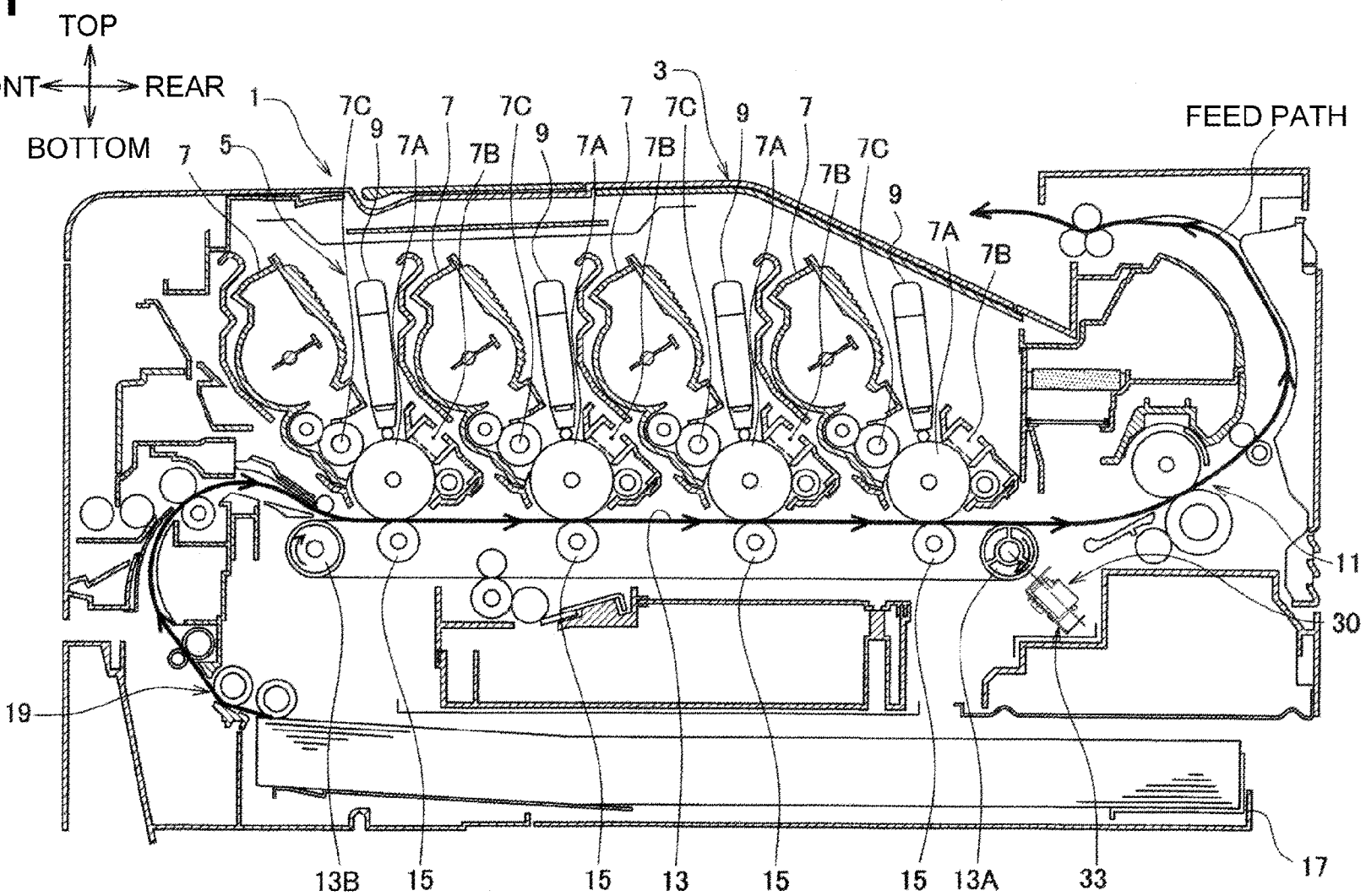
FIG. 1 is a cross-sectional view of an illustrative image forming apparatus according to an embodiment of the disclosure.

As shown in FIG. 1, an image forming apparatus 1 includes an image forming portion 5 in a casing 3. The image forming portion 5 is of an electrophotographic type and is configured to form color images. The image forming portion 5 includes process cartridges 7, light exposure units 9, and a fixing device 11.

The process cartridges 7 are arranged along a direction perpendicular to an axial direction of a photosensitive drum 7A.

The process cartridges 7 are detachably attached to a main body. Each of the process cartridges 7 includes a photosensitive drum 7A, a charger 7B, and a developing roller 7C. The main body refers to a portion of the casing 3, which cannot be detached or replaced by a user.

The photosensitive drum 7A is configured to carry a developer image to be transferred to a sheet. The charger 7B is configured to charge the photosensitive drum 7A. The exposure unit 9 is configured such that an electrostatic latent image is formed on the charged photosensitive drum 7A. The developing roller 7C is configured to supply developer to the photosensitive drum 7A to form a developer image.

A belt 13 is endless and extends between at least two rollers 13A and 13B. The roller 13A is a drive roller to rotate the belt 13. The roller 13B is a driven roller to be rotated following the rotation of the belt 13. The axes of the rollers 13A and 13B are parallel to the axes of the photosensitive drums 7A.

Transfer rollers 15 are disposed on an opposite side of the belt 13 from the photosensitive drums 7A such that the belt 13 is sandwiched between the transfer rollers 15 and the photosensitive drums 7A. The transfer rollers 15 are configured to each transfer the developer image carried on the corresponding photosensitive drum 7A to a sheet fed on the belt 13. The developer images overlaid on the sheet are heated at the fixing unit 11 and fixed to the sheet.

A feeder 19 is disposed upstream of the belt 13 in a sheet feed direction in which the sheet is fed. The feeder 19 is configured to feed a single sheet of sheets on a sheet supply tray 17 toward the image forming portion 5. The sheet supply tray 17 is configured to receive sheets to be fed to the image forming portion 5.

A sensor unit 30 may be disposed such that the sensor unit 30 faces one of the rollers 13A and 13B. In this embodiment, the sensor unit 30 is disposed facing the roller 13A or the drive roller.

Figure 2B:
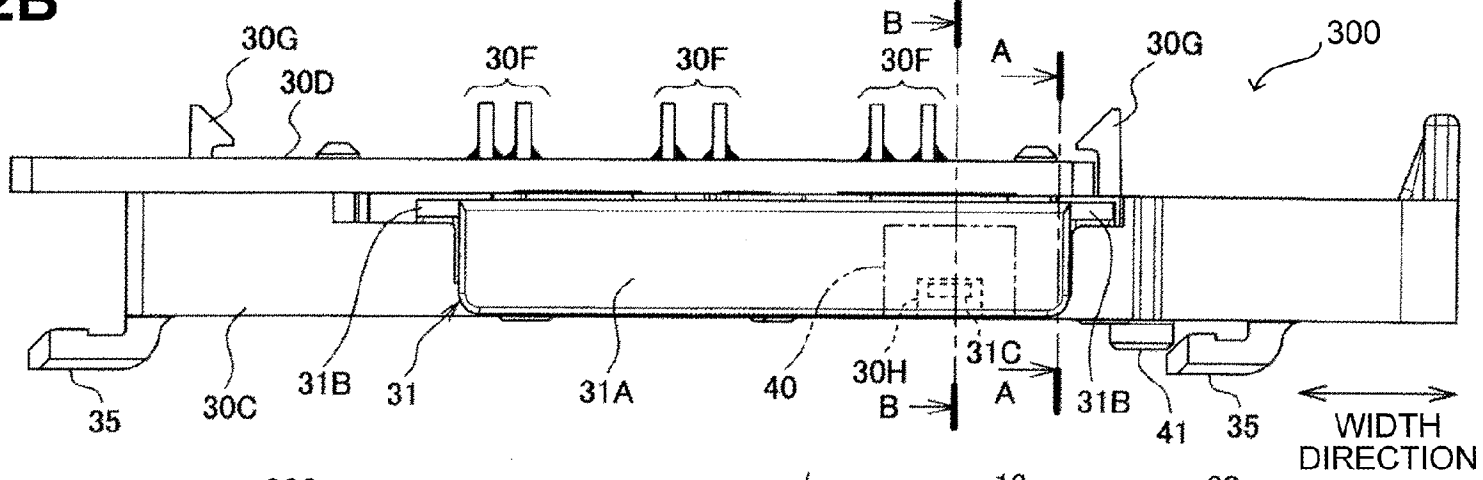
FIG. 2B is a front view of the sensor unit assembly.
Figure 2A:
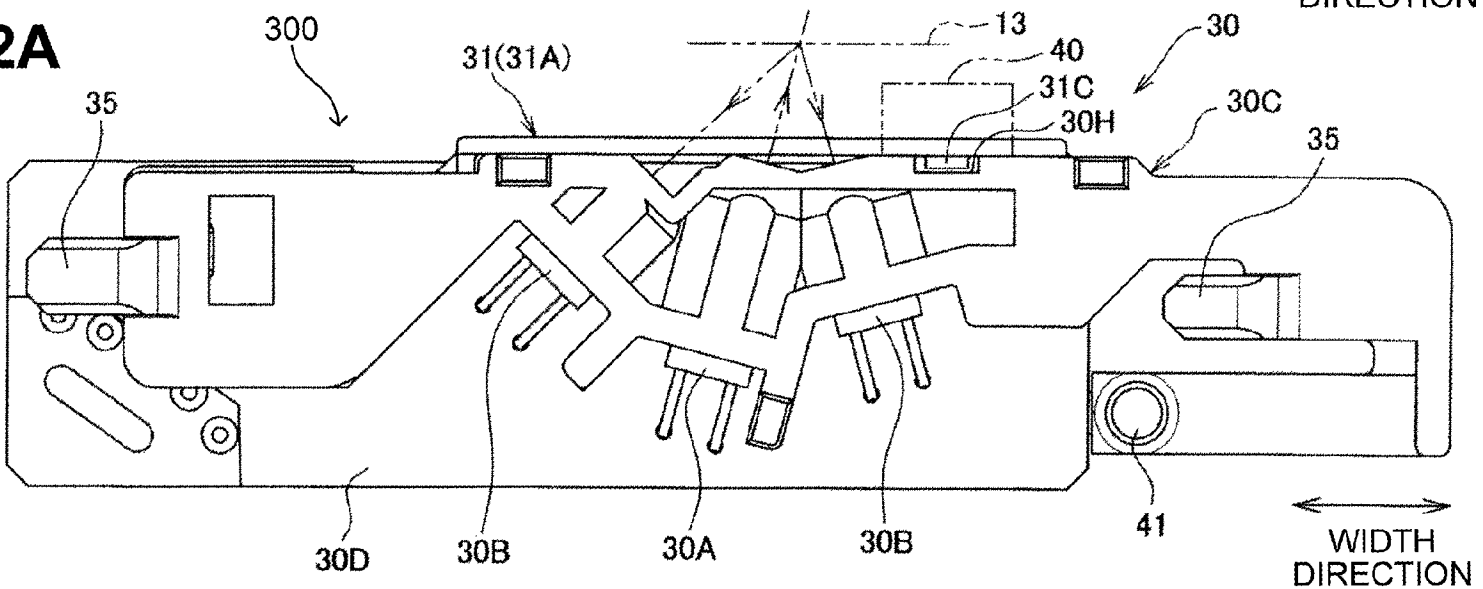
FIG. 2A is a bottom view of a sensor unit assembly.

As shown in FIG. 2A, the sensor unit 30 is a combination of a light emitting element 30A, a pair of light receiving elements 30B and a circuit board 30D. Specifically, as shown in FIG. 2B, leads 30F of the light emitting element 30A and the light receiving elements 30B are mounted through holes drilled in the circuit board 30D.

The light emitting element 30A is configured to emit light toward registration marks (not shown) formed on the belt 13. A light receiving element 30B disposed to the right side in FIG. 2A is configured to receive light regularly reflected from the belt 13. Another light receiving element 30B disposed to the left side in FIG. 2A is configured to receive light reflected via diffuse reflection.

The registration marks are developer images transferred onto the belt 13 for determining a correction amount for shifts and density of overlaid developer images transferred onto a sheet. A controller (not shown) that controls the image forming portion 5 also controls to correct the exposure units 9 using signals emitted from the sensor units 30 as necessary.

The sensor unit 30 is assembled with a holder 30C made of resin. Specifically, the light emitting element 30A and the light receiving elements 30B are fitted in holes (not shown) in the holder 30C and held therein. Hereinafter the combination of the sensor unit 30 and the holder 30C may be referred to as a sensor unit assembly 300.

Figure 6A:
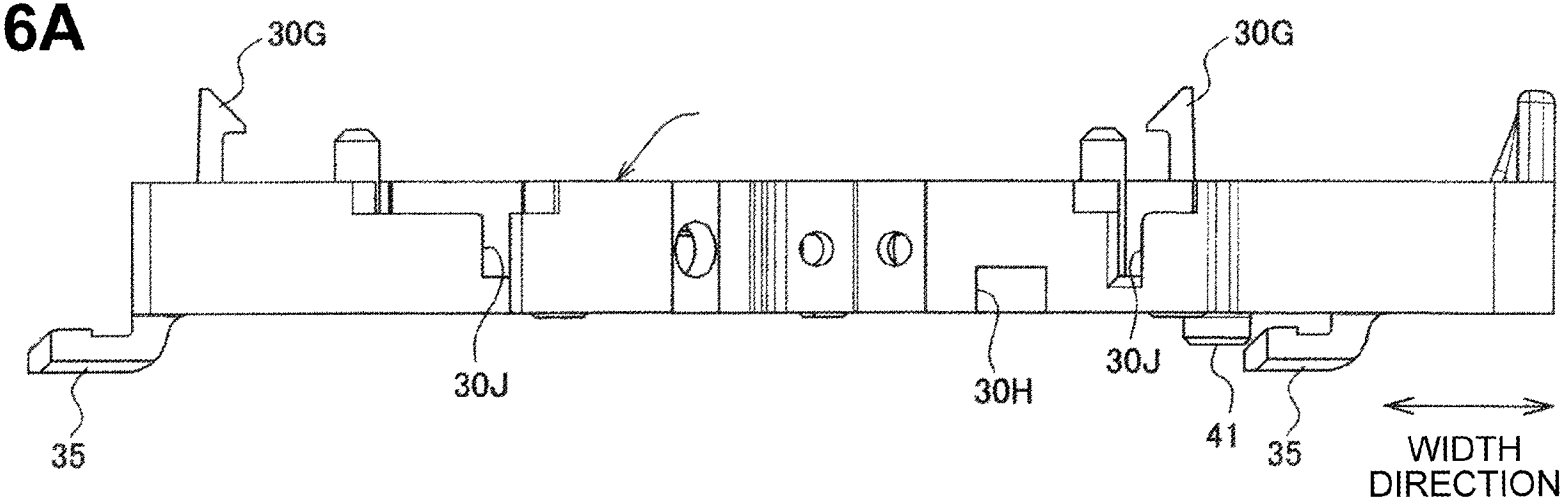
FIG. 6A is a side view of a holder.
Figure 6B:
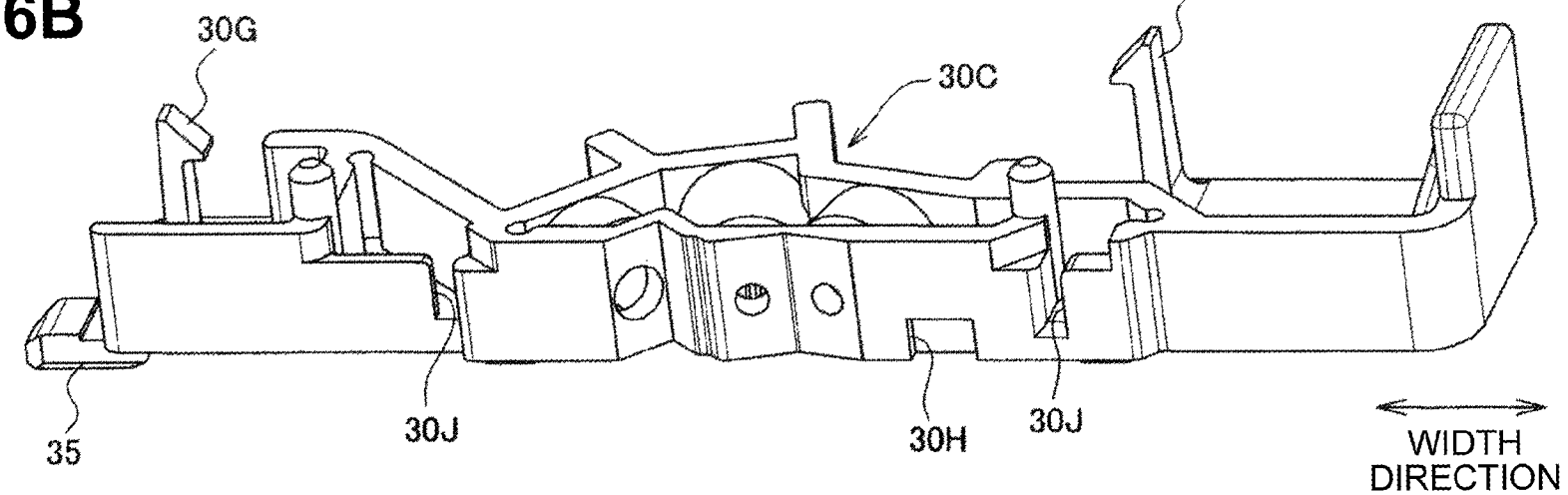
FIG. 6B is a perspective view of the holder.

As shown in FIGS. 2B and 6B, the holder 30C includes a pair of snap fit portions 30G for temporarily fixing the circuit board 30D to the holder 30C. After the circuit board 30D is temporarily fixed to the holder 30C using the snap fit portions 30G, the leads 30F are soldered to the circuit board 30D.

The light emitting element 30A and the light receiving elements 30B are arranged in a width direction, which is parallel to an axis of the roller 13A. A light emitting side of the light emitting element 30A and a light receiving side of each of the light receiving elements 30B are covered by a cover member 31.

A portion of the cover member 31 facing the belt 13 includes a light transmission portion 31A in which light can be transmitted. The light transmission portion 31A is colorless or color transparent to cover the light emitting side of the light emitting element 30A and the light receiving side of the light receiving elements 30B.

Figure 3A:
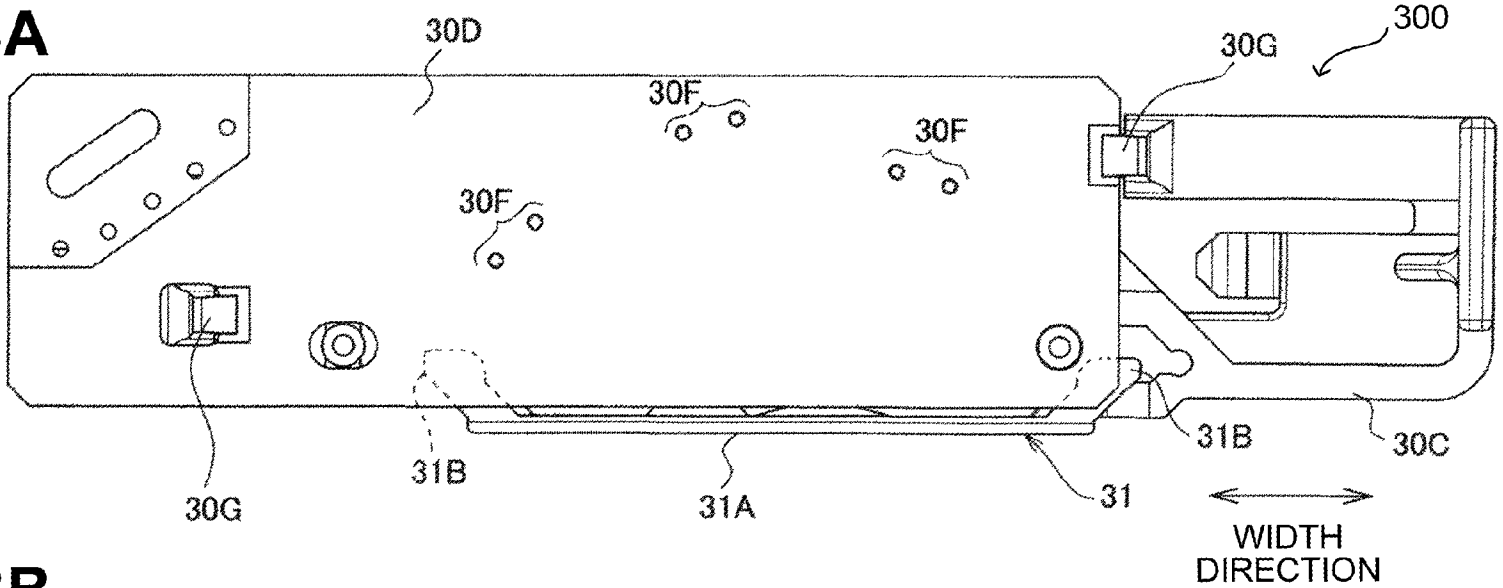
FIG. 3A is a top view of the sensor unit assembly.
Figure 3B:
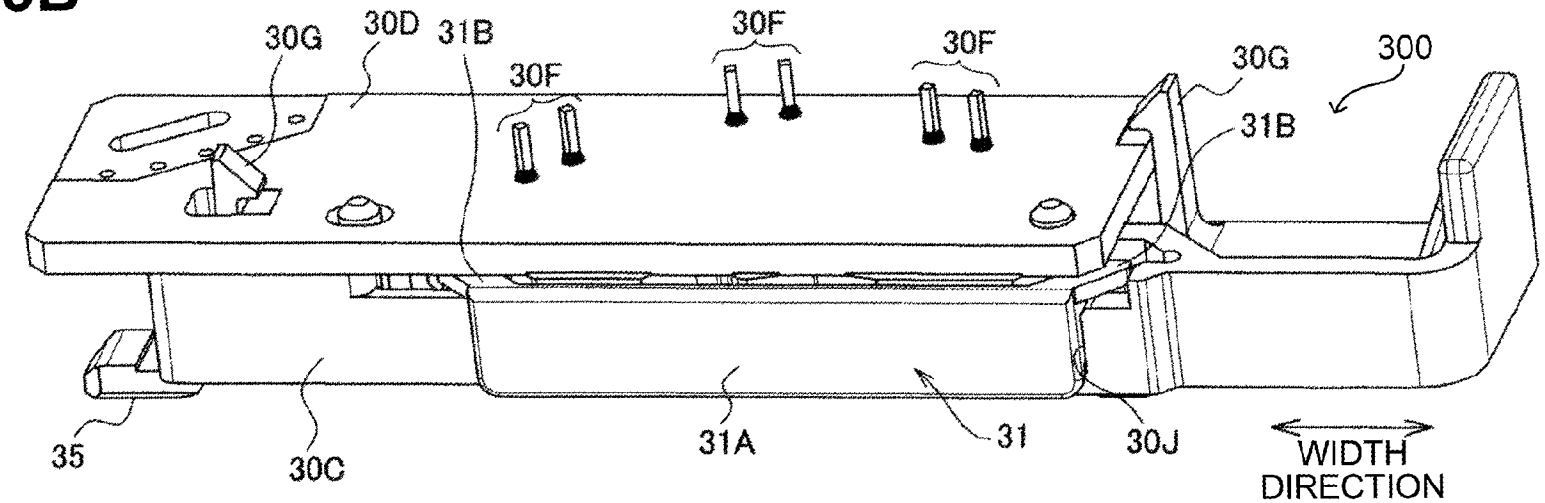
FIG. 3B is a perspective view of the sensor unit assembly.

As shown in FIG. 2B, the cover member 31 includes engaging portions 31B. The engaging portions 31B are sandwiched between the holder 30C and the sensor unit 30. As shown in FIGS. 3A and 3B, the engaging portions 31B are disposed on both sides of the cover member 31 in a width direction and closer to the circuit board 30D.

Figure 4B:
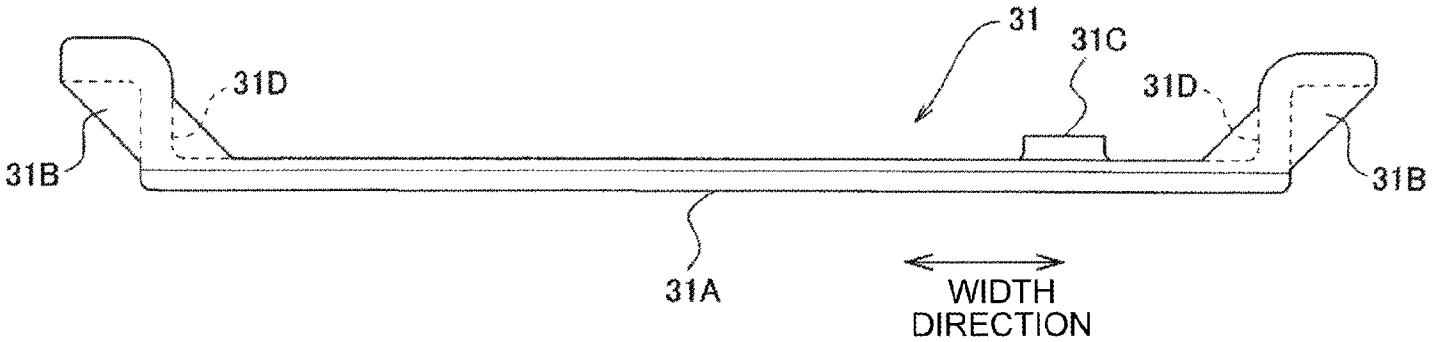
FIG. 4B is a top view of the cover member.
Figure 4A:
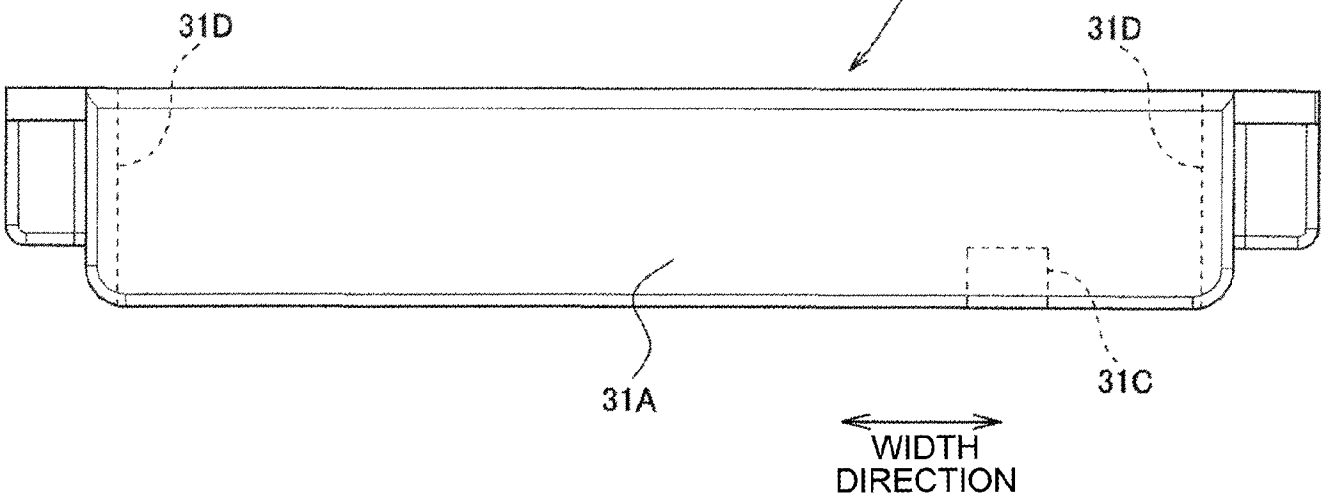
FIG. 4A is a front view of a cover member.

The engaging portions 31B are located between the circuit board 30D and the holder 30C such that the engaging portions 31B protrude in a direction away from the light transmission portion 31A. As shown in FIGS. 4A and 4B, an opposite side of the cover member 31 from the light transmission portion 31A is provided with a first engaging protrusion 31C.

Figure 5B:
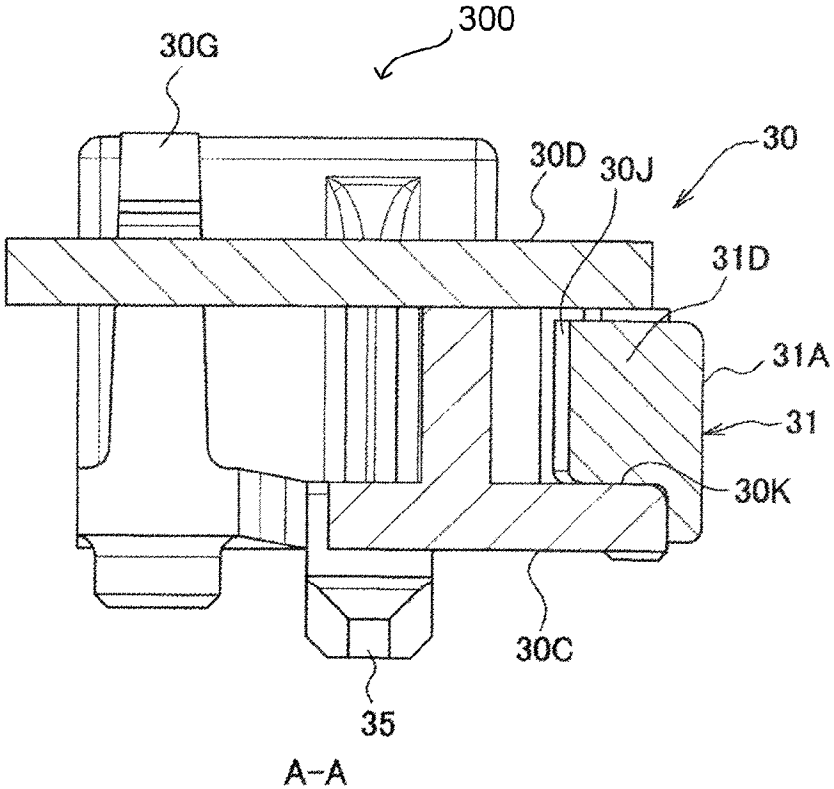
FIG. 5B is a sectional view of the sensor unit taken along the arrowed line A-A of FIG. 2B.
Figure 5A:
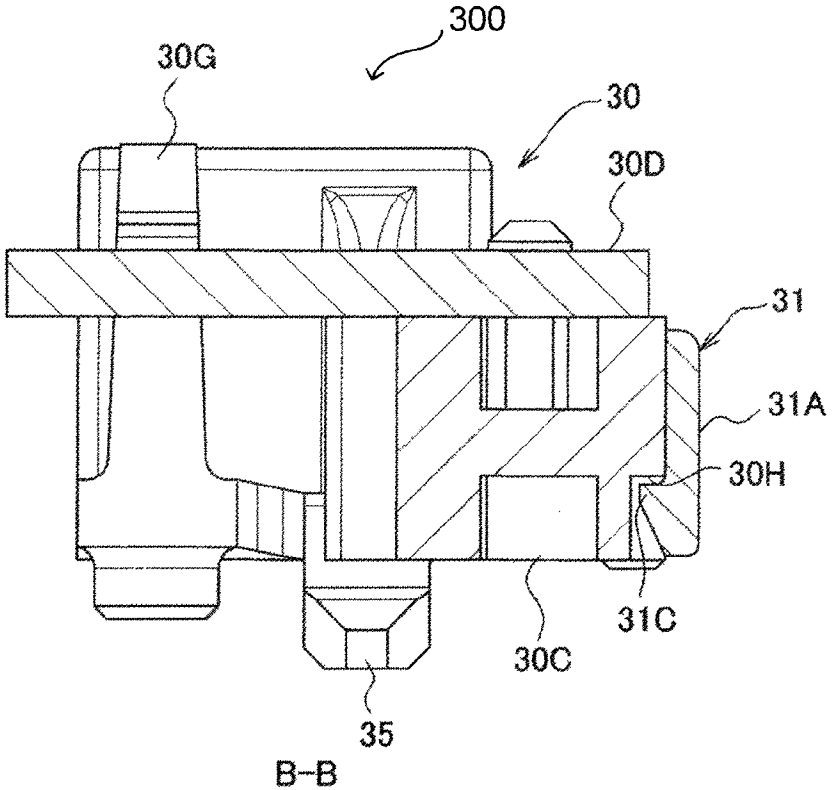
FIG. 5A is a sectional view of the sensor unit taken along the arrowed line B-B of FIG. 2B.

As shown in FIG. 5A, the first engaging protrusion 31C protrudes from the opposite side of the cover member 31 from the light transmission portion 31A toward the holder 30C. The holder 30C is provided with a first engaged portion 30H to be engaged with the first engaging protrusion 31C.

The first engaged portion 30H is recessed in a direction in which the first engaging protrusion 31C protrudes or a direction substantially perpendicular to the light transmission portion 31A. The first engaging protrusion 31C is integrally formed of resin with the light transmission portion 31A and the engaging portions 31B. The first engaging protrusion 31C is configured to elastically deform to engage with the first engaged portion 30H using a snap-fit attachment.

As shown in FIGS. 6A and 6B, the holder 30C is provided with a pair of insertion portions 30J. The insertion portions 30J are grooves in which insertion walls 31D (FIG. 4B) of the cover member 31.

As shown in FIG. 3B, each insertion portion 30J extends from an end portion of the holder 30C closer to the engaging portion 31B or the circuit board 30C toward an end of the light transmission portion 31A. As shown in FIG. 5B, a first contact portion 30K is disposed in an end portion of the insertion portion 30J in a direction where the insertion portion 30J extends. The first contact portion 30K contacts an end portion of the cover member 31 or an end portion of the insertion wall 31D.

Figure 7A:
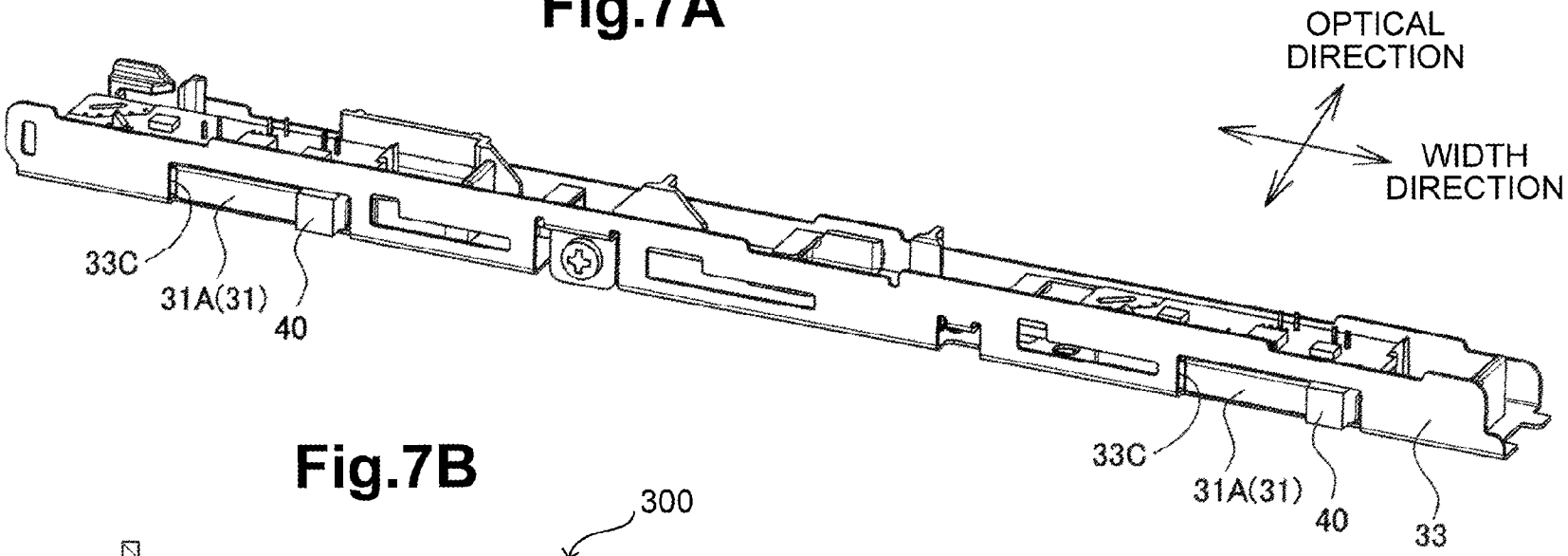
FIG. 7A is a perspective view of a frame to which the sensor unit assembly is attached.

The sensor unit assembly 300 is attached to a base frame 33 shown in FIG. 7A. The base frame 33 is a beam-like member extending in the width direction. The base frame 33 is disposed between a pair of main frames constituting the apparatus main body such that both ends of the base frame 33 in its longitudinal direction are assembled indirectly or directly to the main frames.

Figure 7B:
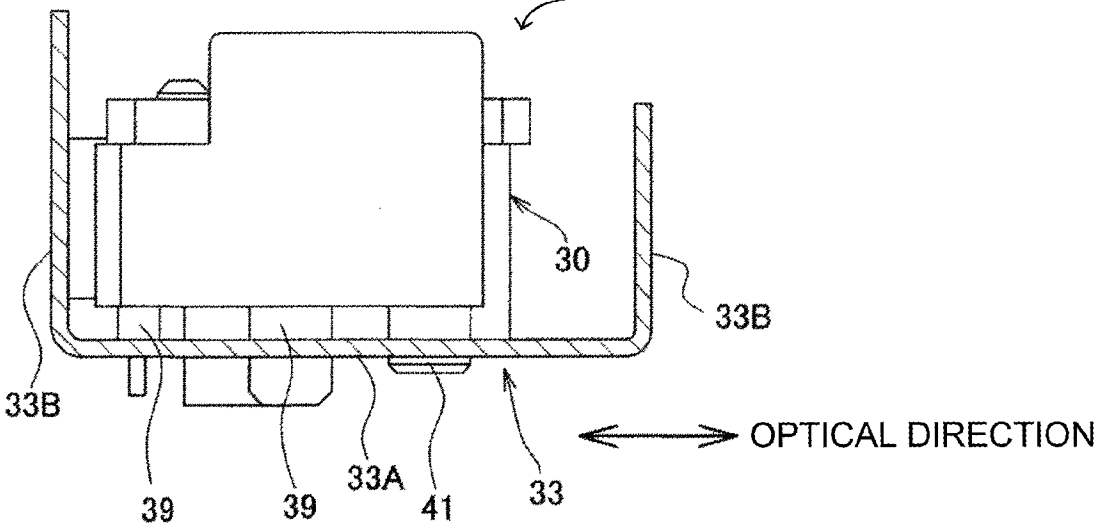
FIG. 7B is a sectional view of the frame.

In the embodiment, two sensor unit assemblies 300 are provided. Each of the sensor unit assemblies 300 is disposed at an end of the base frame 33 in its longitudinal direction. As shown in FIG. 7B, the base frame 30 is open in a direction perpendicular to the longitudinal direction and has a C-shaped cross section.

In other words, the cross section of the base frame 33 has a bottom wall portion 33A and a pair of side wall portions 33B. The bottom wall portion 33A is a band-shaped portion and faces the sensor unit assemblies 300. The side wall portions 33B are band-shaped portions disposed on both ends of the bottom wall portion 33A in the width direction and facing each other.

One of the side wall portions 33B facing the roller 13A is provided with windows 33C through which light passes in or out, as shown in FIG. 7A. Thus, the side wall portions 33B are disposed facing each other in an optical direction such that the sensor unit assemblies 300 are interposed therebetween.

Each sensor unit assembly 300 is identical in structure. The following description will be made based on the sensor unit assembly 300 assembled to the right side of the base frame 33 in FIG. 7A.

Figures 8A, 8B, 8C:
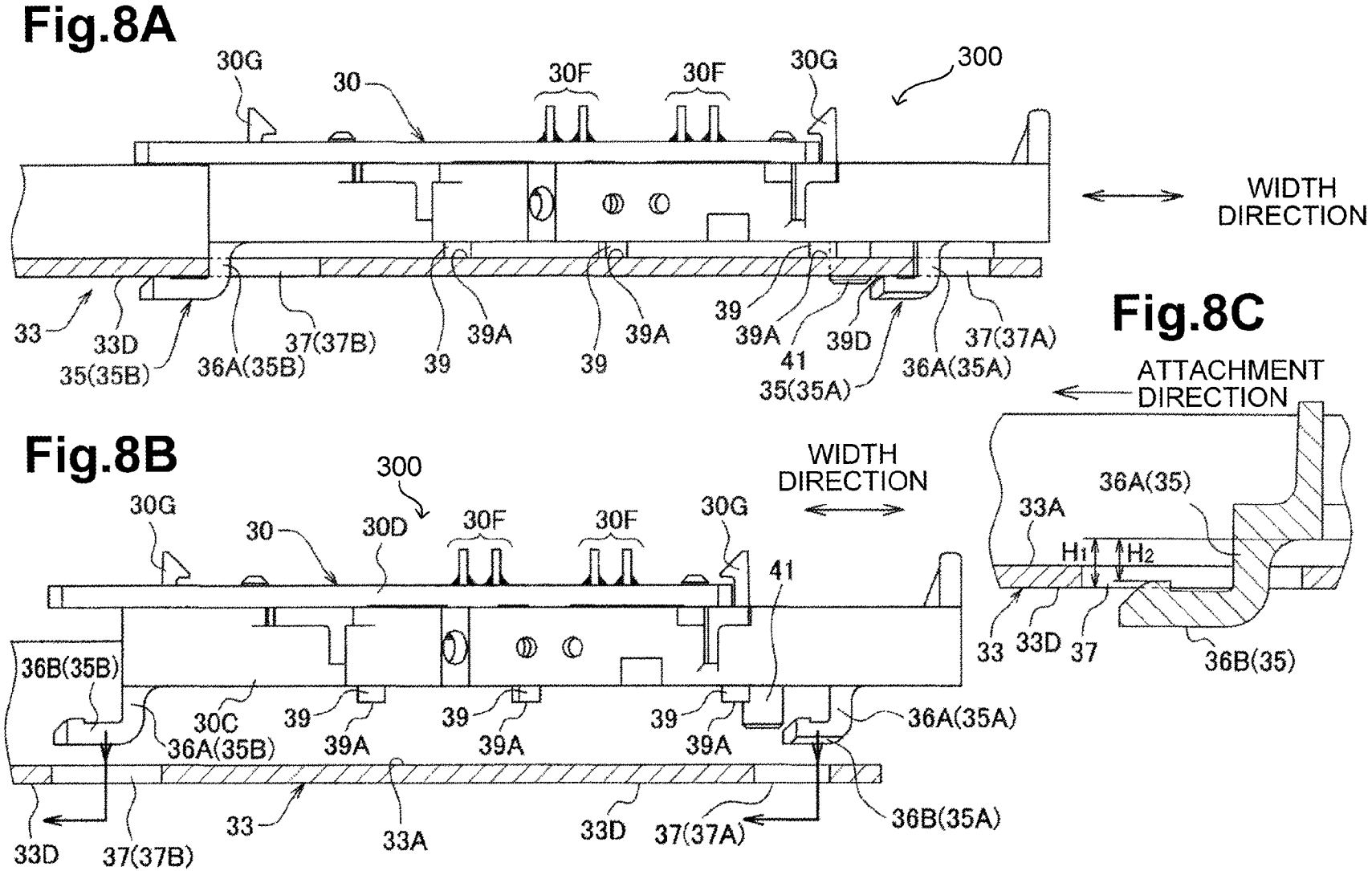
FIG. 8A illustrates the frame to which the sensor unit assembly is attached.
FIG. 8B illustrates the frame before the sensor unit assembly is attached thereto.
FIG. 8C is an enlarged view of a second engaging portion.

As shown in FIG. 8A, the sensor unit assembly 300 is fixed to the base frame 33 by engaging a pair of elastically deformable second engaging portions 35 (35A, 35B) of the sensor unit assembly 300 with a pair of second engaged portions 37 (37A, 37B) of the base frame 33.

The second engaging portions 35 and the second engaged portions 37 are each spaced apart from each other in the longitudinal direction of the base frame 33. Specifically, each of the second engaging portions 35 is disposed on a corresponding one of both ends of the holder 30C extending in the longitudinal direction of the base frame 33. The second engaged portions 37 are disposed in correspondence with the second engaging portions 35.

As shown in FIG. 8B, each second engaging portion 35 has substantially an L-shape. The second engaging portion 35 has two portions, a first extending portion 36A and a second extending portion 36B, which form an L-shape. The first extending portion 36A is a portion protruding in a direction parallel to a direction in which a second protrusion 39 protrudes or in a direction from the sensor unit assembly 300 toward the bottom wall portion 33A.

The second extending portion 36B is a portion extending from an end of the first extending portion 36A in a direction perpendicular to the direction in which the first extending portion 36A protrudes. In the embodiment, the second extending portion 36B of the right-side second engaging portion 35A and the second extending portion 36B of the left-side second engaging portion 35B extend in the same direction.

The direction in which the second extending portion 36B extends is parallel to an axis of the roller 13A or the longitudinal direction of the base frame 33. The direction in which the second extending portion 36B extends or a direction from the right-side second engaging portion 35A toward the left-side second engaging portion 35B (toward left in FIG. 8B) is referred to as an assembly direction.

The right-side second engaged portion 37A is a through hole through which the first extending portion 36A of the right-side second engaging portion 35A passes. Similarly, the left-side second engaged portion 37B is a through hole through which the first extending portion 36A of the left-side second engaging portion 35B passes. The right-side second engaged portion 37A and the left-side second engaged portion 37B are provided in the bottom wall portion 33A.

Hereinafter, the right-side second engaged portion 37A is referred to as a first through hole 37A and the left-side second engaged portion 37B is referred to as a second through hole 37B. The first through hole 37A and the second through hole 37B are collectively referred to as through holes 37.

In the embodiment, each engaging portion 35 can be inserted into a corresponding through hole 37 from a direction perpendicular to the bottom wall portion 33A. When each second extending portion 36B reaches a side of the bottom wall portion 3A opposite to the sensor unit assembly 300 and the sensor unit assembly 300 is moved toward the end of the second extending portion 36B or in the assembly direction, the second extending portion 36B contacts the rim of the through hole 37 and is retained at the rim of the through hole 37 as shown in FIG. 8A.

At least one second protrusion 39 may be disposed in a portion of the holder 30C or the sensor unit assembly 300 to face the bottom wall portion 33A of the base frame 33. The second protrusion 39 protrudes from the portion toward the bottom wall portion 33A and has a second contact portion 39A at an end thereof in its protruding direction to contact the bottom wall portion 33A.

When each second extending portion 36B contacts a surface 33D (hereinafter referred to as a locking surface 33D) of the bottom wall portion 33A opposite to the sensor unit assembly 300 and is retained at the rim of the through hole 37, the second contact portion 39A is pressed by the engaging portion 35 in a direction to increase an area of contact between the engaging portion 35 and the bottom wall portion 33A.

In other words, when the second contact portion 39A contacts the bottom wall portion 33A and the second extending portion 36B is not retained at the rim of the through hole 37, the second extending portion 36B is located closer to the sensor unit assembly 300 than the locking surface 33D is located, as shown in FIG. 8C.

Immediately before the second extending portion 36B contacts the locking surface 33D, a distance H2 from the proximal end of the first extending portion 36A to the second extending portion 36B is smaller than a distance H1 from the proximal end of the first extending portion 36A to the locking surface 33D.

Thus, when the second extending portion 36B contacts the locking surface 33D and is retained at the rim of the through hole 37, the engaging portion 35 is elastically deformable and the second contact portion 39A is pressed against the locking surface 33D.

As shown in FIG. 8B, the holder 30C or the sensor unit assembly 300 includes a third protrusion 41 at a portion of the holder 30C to face the bottom wall portion 33A of the base frame 33. The third protrusion 41 protrudes from the portion of the holder 30C toward the bottom wall portion 33A to fit in a recessed portion (not shown) therein. The third protrusion 41 contacts an inner surface of the recessed portion such that the third protrusion 41 does not move in the assembly direction.

As shown in FIG. 7A, a cleaning member 40 is disposed on a surface of the light transmission portion 31A facing the belt 13. The cleaning member 40 is configured to move relative to the light transmission portion 31A to wipe the surface of the light transmission portion 31A.

The cleaning member 40 is made of an elastically deformable material, e.g., a sponge. The cleaning member 40 contacts the light transmission portion 31A in the compressively deformed state. In other words, the cleaning member 40 elastically deforms and presses the cover member 31 against the holder 30C.

Figure 9:
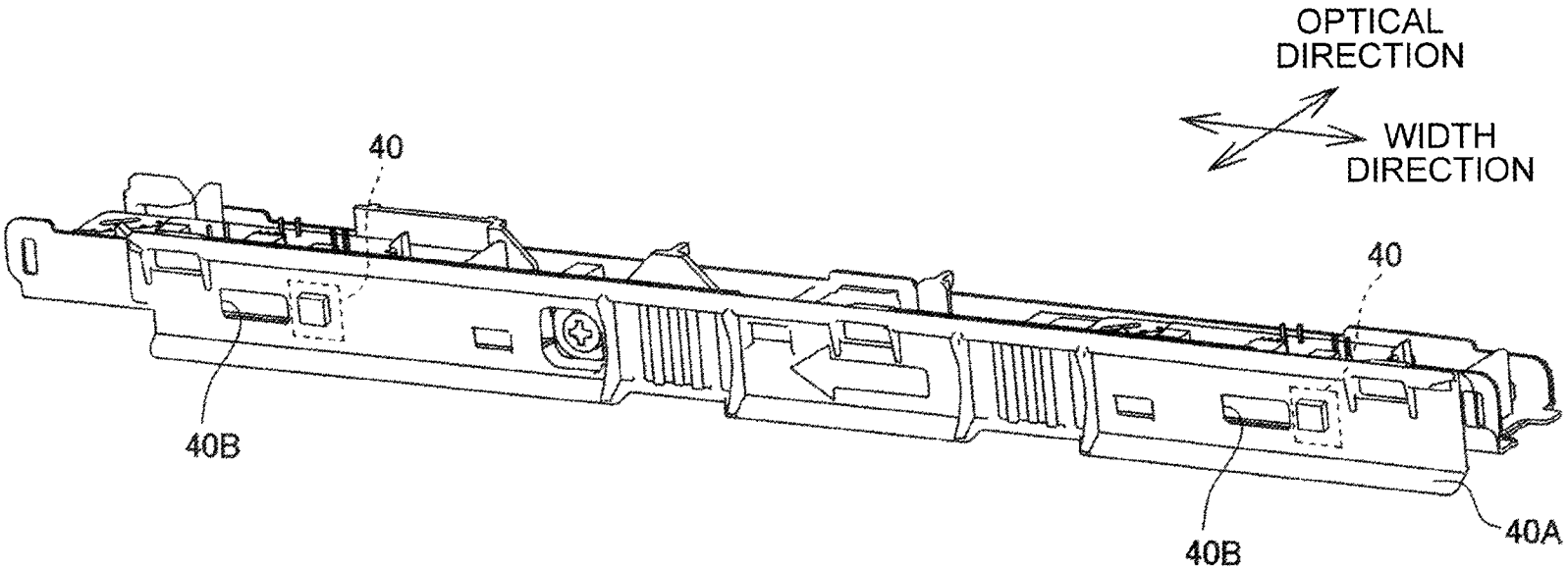
FIG. 9 is a perspective view of the frame to which a movable member is attached.

As shown in FIG. 9, the cleaning member 40 is fixed to a movable member 40A. The movable member 40A is disposed on the same side of the base frame 33 as the window 33C and assembled to the base frame 33 movably in the width direction relative to the base frame 33.

When the movable member 40A is moved in the width direction, the cleaning members 40, which deform under compression, move in the width direction along with the movable member 40A. Thus, the light transmission portions 31A are wiped by the cleaning members 40.

The movable member 40A has windows 40B for allowing light to pass through the light transmission portion 31A. Each window 40B is disposed in such a position that, when the cleaning member 40 is disposed in a standby position, the widow 40B overlaps the light emitting side of the light emitting element 30A and the light receiving side of the light receiving elements 30B.

The standby position is set in an end of movement of the cleaning member 40 in a moving direction in which the cleaning member 40 moves. In the standby position, the cleaning member 40 is shifted with respect to the light emitting side of the light emitting element 30A and the light receiving side of the light receiving elements 30B in the moving direction. In other words, when the cleaning member 40 is in the standby position, the cleaning member 40 does not cut off the light passing the light transmission portion 31A.

Figure 10:
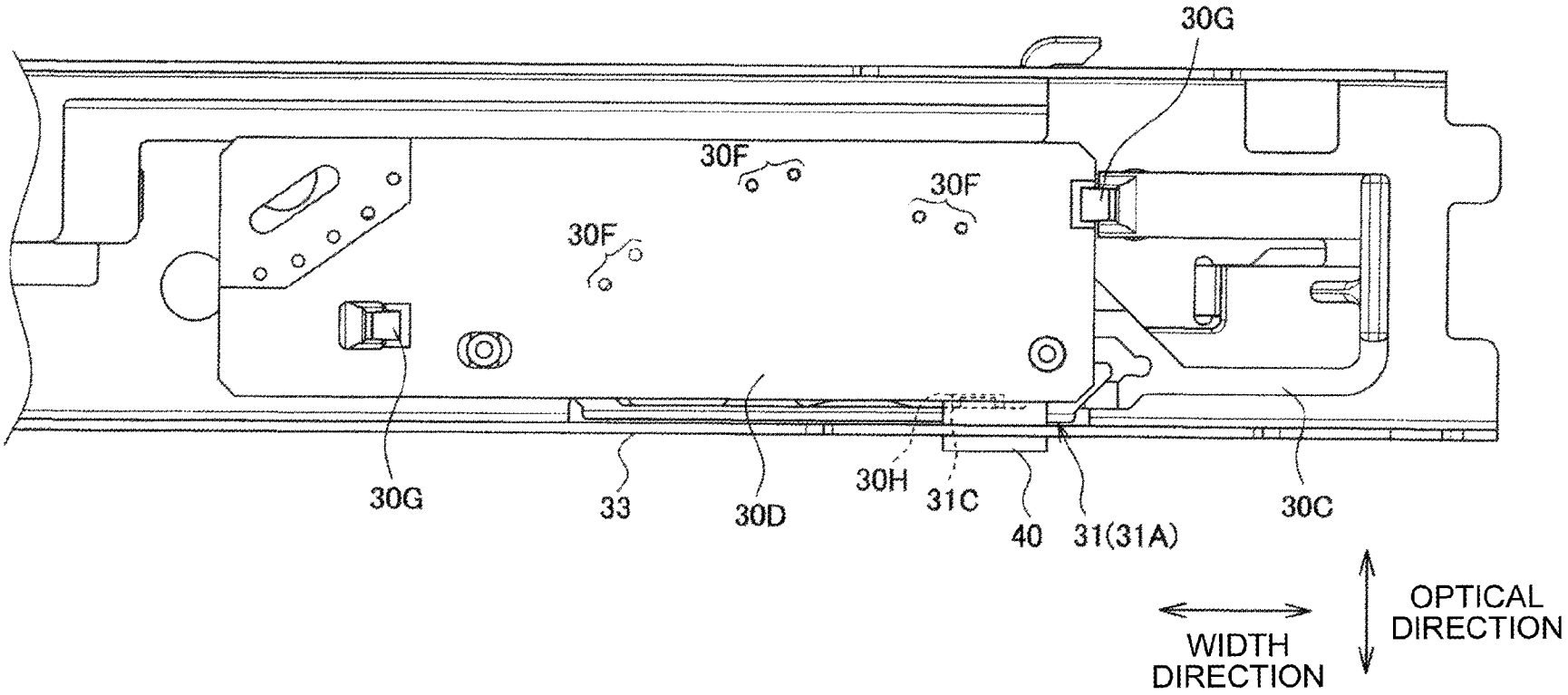
FIG. 10 illustrates a positional relationship between a first engaging protrusion, a first engaged portion and a cleaning member in a standby position.

FIG. 10 illustrates that the cleaning member 40 is in the standby position. The first engaging protrusion 31C and the first engaged portion 30H are located toward the standby position in the moving direction of the cleaning member 40 or in the width direction.

When the first engaging protrusion 31C and the standby position are projected on an imaginary plane perpendicular to the direction in which the first engaging protrusion 31C protrudes or projected on a flat surface portion of the light transmission portion 31A, the first engaging protrusion 31C and the standby position overlap each other.

In the state where the cleaning member 40 is in the standby position, when the first engaging protrusion 31C, the first engaged portion 30H and the cleaning member 40 are projected on the imaginary plane, they overlap each other as shown in FIG. 2B.

In the embodiment, the cover member 31 includes the engaging portions 31B sandwiched between the holder 30C and the sensor unit 30.

As the engaging portions 31B of the cover member 31 are sandwiched between the holder 30C and the sensor unit 30, the cover member 31 can be prevented from coming off unintentionally.

In the embodiment, the cover member 31 includes the first engaging protrusion 31C protruding toward the holder 30C, and the holder 30C includes the first engaged portion 30H to be engageable with the first engaging protrusion 31C.

As the first engaging protrusion 31C engages with the first engaged portion 30H, the cover member 31 can be prevented from coming off or being shifted greatly even when a great force acts on the cover member 31.

In the embodiment, the cleaning member 40 elastically deforms to press the cover member 31 against the holder 30C.

The restoring force of the cleaning member 40 elastically deforming acts on the cover member 31 as a retaining force to retain the engagement between the first engaged portion 30H and the first engaging protrusion 31C. Thus, the cover member 31 can be prevented from coming off unintentionally.

In the embodiment, the cleaning member 40 is fixed to the movable member 40A which is movable relative to the base frame 33.

When the movable member 40A moves, the cleaning member 40 moves relative to the light transmission portion 31A while contacting the light transmission portion 31A. When the cleaning member 40 moves, the cleaning member 40 wipes the light transmission portion 31A.

In the embodiment, the first engaging protrusion 31C and the first engaged portion 30H are located toward the standby position.

When the cleaning member 40 is in the standby position in which it does not wipe the light transmission portion 31A, the cleaning member 40 is disposed in vicinity of the first engaging protrusion 31C and the first engaged portion 30H. The restoring force of the cleaning member 40 can be effectively used as the retaining force.

In the embodiment, when the first engaging protrusion 31C and the standby position are projected on the imaginary plane, the first engaging protrusion 31C and the standby position overlap each other. Thus, the restoring force of the cleaning member 40 can be reliably used as the retaining force.

In the embodiment, the holder 30C includes the first contact portion 30K, which is disposed in the end portion of the insertion portion 30J and configured to contact the end portion of the cover member 31.

Thus, the cover member 31 is positioned when the end portion thereof contacts the first contact portion 30K. The cover member 31 is easily assembled in the holder 30C and held in position.

In the embodiment, the sensor unit assembly 300 can be attached to the base frame 33 in position without using screws. Generally, a fixing operation by engagement is smaller in the number of processes than a fixing operation by tightening screws. This structure facilitates accurate assembly of the sensor unit assembly 300 to the base frame 33 while achieving a reduction in the number of processes for assembly.

The embodiment shows, but is not limited to that the cover member 31 includes the first engaging protrusion 31C protruding toward the holder 30C and that the holder 30C includes the first engaged portion 30H engageable with the first engaging protrusion 31C.

In other words, the holder 30C may include the first engaging protrusion 31C protruding toward the cover member 31 and the cover member 31 may include the first engaged portion 30H engageable with the first engaging protrusion 31C.

The embodiment shows, but is not limited to that the cleaning members 40. The cleaning members 40 may be omitted.

The embodiment shows, but is not limited to that the first engaging protrusion 31C and the first engaged portion 30H are located toward the standby position. The first engaging protrusion 31C and the first engaged portion 30H may be located in different positions.

The embodiment shows, but is not limited to that, when the cleaning member 40 is in the standby position, the first engaging protrusion 31C, the first engaged portion 30H, and the cleaning member 40 overlap each other in the direction in which the first engaging protrusion 31C protrudes.

The embodiment shows, but is not limited to that the first contact portion 30K is disposed in the insertion portion 30J of the holder 30C to position the cover member 31.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a sheet, the image forming unit including a plurality of photosensitive drums;

a belt configured to contact the photosensitive drums and to receive registration marks thereon;

a sensor unit assembly including:

a sensor unit including a light emitting element configured to emit light toward the belt, a light receiving element configured to receive light reflected from the belt to detect the registration marks, and a circuit board on which the light emitting element and the light receiving element are mounted; and a holder attached to the circuit board; and a cover member attached to the sensor unit assembly, the cover member including a light transmission portion covering a light emitting side of the light emitting element and a light receiving side of the light receiving element and an engaging portion sandwiched between the circuit board and the holder, wherein the cover member extends in a direction away from a first surface of the circuit board facing the holder, such that any part of a second surface of the circuit board, which is opposite to the first surface, is not covered by the cover member.

2. The image forming apparatus according to claim 1, wherein one of the cover member and the holder includes a first engaging protrusion protruding from the one to the other of the cover member and the holder, and wherein the other of the cover member and the holder includes a first engaged portion configured to engage the first engaging protrusion.

3. The image forming apparatus according to claim 2, wherein the cover member includes the first engaging protrusion and the holder includes the first engaged portion.

4. The image forming apparatus according to claim 2, further comprising a cleaning member configured to move relative to the light transmission portion of the cover member and to wipe the light transmission portion, wherein the cleaning member is configured to elastically deform to press the cover member against the holder.

5. The image forming apparatus according to claim 4, further comprising:

a frame to which the sensor unit assembly is fixed; and a movable member attached to the frame such that the movable member moves relative to the frame, wherein the cleaning member is fixed to the movable member.

6. The image forming apparatus according to claim 5, wherein one of the sensor unit assembly and the frame includes:

a second protrusion protruding toward the other of the sensor unit assembly and the frame, the second protrusion having a second contact portion contacting the other of the sensor unit assembly and the frame; and a second engaging portion configured to elastically deform to press the second protrusion in a direction to increase an area of contact between the second engaging portion and the other of the sensor unit assembly and the frame, and wherein the other of the sensor unit assembly and the frame includes a second engaged portion configured to engage the second engaging portion.

7. The image forming apparatus according to claim 1, wherein the holder includes:

an insertion portion receiving a part of the cover member; and a first contact portion disposed at an end of the insertion portion, the first contact portion contacting an end of the cover member.

8. The image forming apparatus according to claim 1, wherein the engaging portion is disposed on both sides of the cover member in a width direction.

9. The image forming apparatus according to claim 1, wherein the sensor unit further includes another light receiving element mounted on the circuit board and configured to receive light reflected via diffuse reflection, and wherein the cover member covers a light receiving side of the other light receiving element.

10. The image forming apparatus according to claim 1, further comprising:

a main body including a first main frame and a second main frame facing the first main frame; and a frame extending between the first main frame and the second main frame of the main body, the sensor unit assembly being disposed at an end portion of the frame.

11. The image forming apparatus according to claim 10, further comprising another sensor unit assembly, the other sensor unit assembly being disposed at an end portion of the frame in a width direction opposite to the sensor unit assembly.

12. An image forming apparatus comprising:

an image forming unit configured to form an image on a sheet;

a sensor unit assembly including:

a sensor unit including a light emitting element and a light receiving element; and a holder attached to the sensor unit;

a cover member attached to the sensor unit assembly, the cover member including a light transmission portion covering a light emitting side of the light emitting element and a light receiving side of the light receiving element and an engaging portion sandwiched between the sensor unit and the holder; and a cleaning member configured to move relative to the light transmission portion of the cover member and to wipe the light transmission portion, wherein one of the cover member and the holder includes a first engaging protrusion protruding from the one to the other of the cover member and the holder, wherein the other of the cover member and the holder includes a first engaged portion configured to engage the first engaging protrusion, and wherein when the cleaning member is disposed in a standby position which is set at an end of movement of the cleaning member in a direction in which the cleaning member moves, the first engaging protrusion and the first engaged portion are located toward the standby position.

13. The image forming apparatus according to claim 12, wherein, when the first engaging protrusion and the standby position are projected on an imaginary plane perpendicular to a direction in which the first engaging protrusion protrudes, the first engaging protrusion and the standby position overlap each other.

* * * * *